US005077925A

United States Patent [19]

Herrera et al.

[11] Patent Number: 5,077,925

[45] Date of Patent: Jan. 7, 1992

[54] MESSAGE FRAME

[76] Inventors: Barbaranne D. Herrera, 4519 W. 162nd St., Lawndale, Calif. 90260; Robert G. Posey, 21 Alamitus Ave. #17, Long Beach, Calif. 90802

[21] Appl. No.: 512,459

[22] Filed: Apr. 23, 1990

[51] Int. Cl.[5] ..... G09F 3/18

[52] U.S. Cl. ..... 40/642; 40/591; 40/611

[58] Field of Search ..... 40/591, 593, 152, 642, 40/584, 491, 611, 210, 107, 154, 155

[56] References Cited

U.S. PATENT DOCUMENTS

| | | | |
|---|---|---|---|
| 2,306,115 | 12/1942 | Bowder | 40/152 X |
| 3,561,146 | 2/1971 | Dembar | 40/152 |
| 3,703,045 | 11/1972 | Nyman | 40/152 |
| 3,711,246 | 11/1973 | Ebner | 40/152.1 |
| 3,774,332 | 11/1973 | Schneider | 40/152.1 |
| 4,103,860 | 8/1978 | Haas et al. | 40/154 X |
| 4,453,328 | 6/1984 | Connolly | 40/210 |

FOREIGN PATENT DOCUMENTS

| | | | |
|---|---|---|---|
| 2308978 | 9/1974 | Fed. Rep. of Germany | 40/154 |
| 705420 | 6/1931 | France | 40/152 |
| 1098735 | 8/1955 | France | 40/107 |
| 2340704 | 9/1977 | France | 40/155 |

*Primary Examiner*—Kenneth J. Dorner
*Assistant Examiner*—Brian K. Green
*Attorney, Agent, or Firm*—Roger A. Marrs

[57] ABSTRACT

A frame is disclosed herein having an elongated base with opposite side rails defining an exposed message area therebetween occupied by a resilient pad. A message sheet is placed between the pad and a transparent window or layer which is slidably carried on the side rails to cover and protect the message sheet. Stop abutments are provided to limit sliding of the window and a snap-lock mechanism is employed for releasably retaining the window in place over the message sheet.

1 Claim, 1 Drawing Sheet

MESSAGE FRAME

BACKGROUND OF THE INVENTION

1. Field of the Invention

The present invention relates to display devices and more particularly to a novel display frame for bumper stickers or message-bearing material which is carried on a frame for direct mounting to a supporting structure such as an automobile bumper or the like.

2. Brief Description of the Prior Art

In the past, it has been the conventional practice to produce messages on adhesive backed material which is then affixed to a supporting structure such as the bumper of an automobile. Although this is a suitable means for mounting such a message, problems and difficulties have been encountered which stem largely from the fact that should the message material be removed from the supporting structure, generally physical damage to the structure as well as to its cosmetic content result. The original adhesive has a tendency to pull or destroy the surface to which it is affixed when the message material is removed.

In particular, with the painted rubber components of which late model automobile bumpers are composed, a bumper sticker can remove portions of the paint and cause cosmetic damage to the surface when it is removed after having been mounted on the surface for an extended period of time. Additionally, the message is destroyed when it is removed preventing any further use.

Therefore, a long-standing need has existed to provide a means for displaying a message or graphic subject matter in the form of a bumper sticker on a motor vehicle which will not cause damage to the mounting surface when it is removed.

SUMMARY OF THE INVENTION

Accordingly, the above problems and difficulties are obviated by the present invention which provides a novel display case or frame comprising an elongated base having a continuous sidewall raised above a display surface around the edge marginal region of the base so as to define a display area between the raised walls. A resilient pad is disposed in the display area onto which a display message sheet is carried. A slidable transparent sheet characterized as a window is slidably disposed in the opposite sidewalls by means of a track groove construction which insertably receives the edge marginal regions of the window sheet. Means are provided for limiting the disposition of the window sheet in the guide means and the snap-lock means is included for releasably holding the window sheet in position on the base. Also, attachment means are provided on the base for securing the base to supporting structure.

Therefore, it is among the primary objects of the present invention to provide a novel display frame for graphic or alpha/numeric messages that may be readily installed in an easy manner onto a supporting structure, such as an automobile bumper.

Another object of the present invention is to provide a novel message carrier having means for permitting replacement of messages on a display area carried beneath a sliding window panel or sheet.

Still another object of the present invention is to provide a novel and inexpensive frame for holding a display message onto the structure of an automobile wherein the message may be replaced with alternate messages at the discretion of the user and wherein the message carrier can be removed from the supporting structure without structural o cosmetic damage thereto.

BRIEF DESCRIPTION OF THE DRAWINGS

The features of the present invention, which are believed to be novel, are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
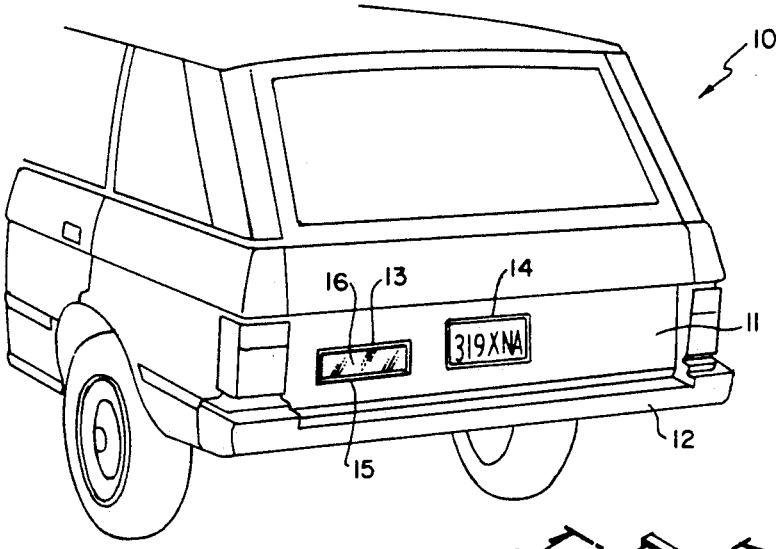
FIG. 1 is a perspective view showing the novel message carrier or holder of the present invention mounted on supporting structure of a motor vehicle.

Referring to FIG. 1, a vehicle is indicated in the general direction of arrow 10 which includes a rear panel 11 and a bumper 12 which may be combined together or which may be of separate construction. The novel message carrier of the present invention is indicated in general by numeral 13 and is illustrated as being disposed or mounted on the panel 11; however, it is to be understood that the carrier may also be placed on the bumper 12 at the discretion of the user. Additionally, the rear of the vehicle includes a conventional mounting of a license plate, as indicated by numeral 14, and such a conventional license plate carrier or frame is not to be confused with the present invention. By installing the novel message carrier or frame 13 to the vehicle, the frame may be removed at a later time without damage to the construction or the cosmetics of the vehicle itself. The novel message carrier includes a base 15 which holds a sliding window 16 under which the message appears.

Figure 2:
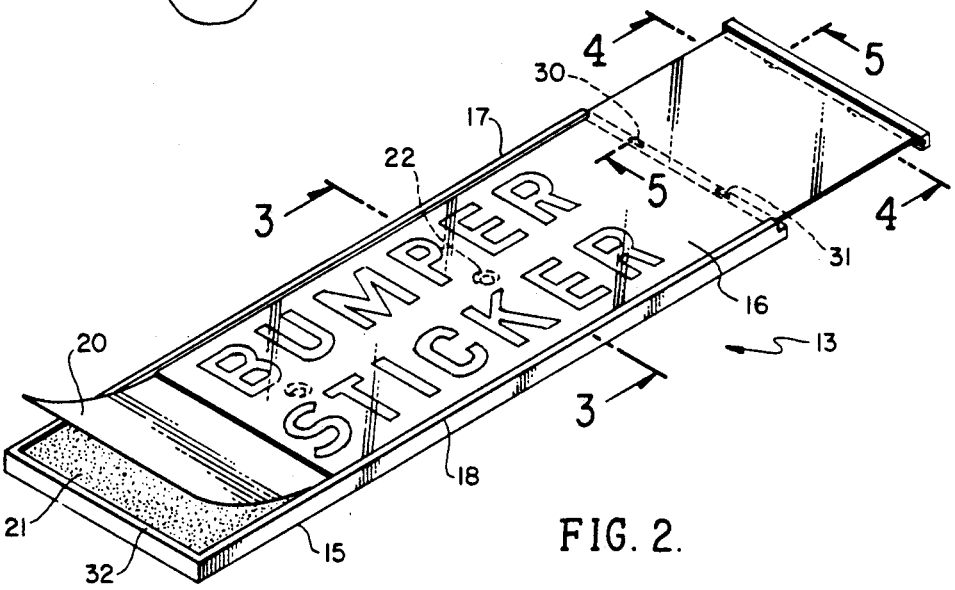
FIG. 2 is an enlarged perspective view showing the novel message carrier or holder incorporating the present invention.

Referring now in detail to FIG. 2, the message frame or holder 13 includes the base 15 which carries opposite sidewalls 17 and 18 on opposite sides of the base so as to define a central display area between the opposing walls into which a message sheet 20 is disposed. The message sheet includes graphic subject matter and/or alpha/numeric information intended to be viewed through the transparent window or cover 16. Immediately beneath the message sheet 20, there is provided a resilient pad 21.

The resilience of the pad 21 will urge the message sheet 20 into yieldable engagement with the underside of the window panel or sheet 16 so that the message sheet will be held in place and will not be dislodged from its viewing position.

The base 15 further includes means for mounting the carrier or holder onto the supporting structure which includes a pair of apertures, such as aperture 22 through which screws or other fasteners may be inserted to hold the base onto the supporting structure. Additionally, it is to be understood that adhesive may be placed on the back side of the base 15 for attachment to the supporting structure. This adhesive is not of the character or nature that is used with bumper stickers, which is usually of a metallic high contact adhesive composition, so that the base 15 may be removed from the supporting structure without damage. In any event, while the frame or carrier is affixed to the supporting structure, various message displays can be introduced to the holder without removal of the frame.

FIG. 2 further illustrates that the window panel 16 is inserted into position over the top of the message sheet 20 by sliding the edge marginal regions of the panel into slot receptacles formed in the sidewalls 17 and 18 respectively. The slots are indicated by numerals 23 and 24 in FIG. 3.

Figure 3:
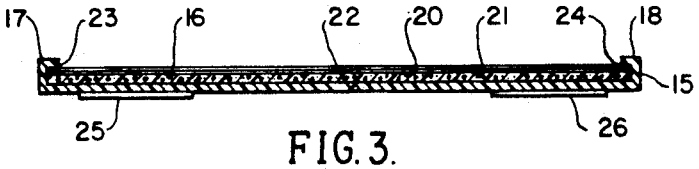
FIG. 3 is a transverse cross-sectional view of the message holder shown in FIG. 2 as taken in the direction of arrows 3—3 thereof.

FIG. 3 further illustrates that the pad 21 is immediately under the message sheet 20 and that the window panel 16 is immediately over the message sheet 20. The back side or bottom of the base 15 may include adhesive strips 25 and 26 so that the user has the opportunity of either employing the fastener holes 22 for attachment of the base to the supporting structure or using the adhesive 25 or 26 for affixing the base to the supporting structure.

The grooves 23 and 24 serve as a guide means and as a retaining means for holding the panel 16 in position as it is slid over the top of the message material 20.

Figure 5:
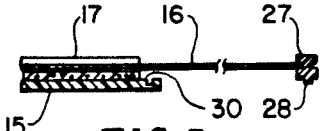
FIG. 5 is a sectional fragmentary view of the message carrier shown in FIG. 2 as taken in the direction of arrows 5—5 thereof.
Figure 4:
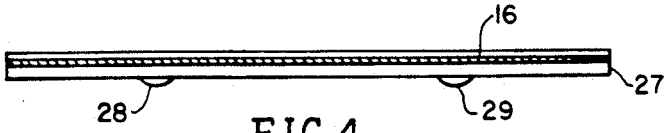
FIG. 4 is a transverse cross-sectional view taken in the direction of arrows 4—4 of FIG. 2.

FIGS. 4 and 5 further illustrate that the window panel 16 includes an end piece 27 which has a pair of downwardly depending nubs 28 and 29 that serve as detents for snap-locking into position with receptacles 30 and 31 carried on the base 15 at one end of its length. The opposite end of the base 15 includes an end wall 32 against which the end of the panel 16 abuts to arrest slidable movement across the display area. The abutment of the end of the panel coincides with the introduction of detents 28 and 29 into the receptacles 30 and 31 respectively.

In view of the foregoing, it can be seen that the novel message carrier or holder of the present invention provides a means for carrying display messages that may be readily changed from time to time without the necessity of removing the carrier or holder from its supporting structure, whether it be an automobile panel or the bumper of the automobile. To install a message, the window panel 16 is slid out of its retainment with the sidewalls of the base so as to expose the surface of the pad 21. It is unnecessary that the adhesive normally carried on the back side of bumper stickers be exposed. The resiliency of the pad 21 will force the message sheet against the underside of the window panel once the window panel has been reintroduced into the base 15. This latter condition is achieved by inserting the end of the panel 16 into the slotted grooves 23 and 24 so that the panel may be slid across the full length of the base on top of the message material or sheet 20. Upon abutment of the end of the panel with the end wall 32, the nubs 28 and 29 operating as detents will snap into the receptacles 30 and 31 for releasable or yieldable retention of the panel on the base.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A message display device comprising the combination of:

a message display sheet having an elongated display surface carrying indicia;

an elongated base releasably holding said display sheet and having opposite side walls joined by an integral end wall defining a display area between said walls;

a resilient pad disposed in said display area immediately behind and in contact with said display sheet;

a movable transparent window slidably carried on said side walls for selectively covering and uncovering said display sheet indicia;

guide slots provided in said side walls for insertably receiving the opposite edge marginal regions of said window;

stop means cooperatively carried between said window and said base for limiting movement therebetween;

a snap-lock means releasably holding said window to said base;

said window is an elongated sheet of transparent material having a wall carried on one end constituting said stop means and adapted to align in a perpendicular manner with respect to said side walls;

said end wall on said window carrying detents operable with receptacles in said base to constitute said snap-lock means;

attachment means for affixing said base to a supporting structure.

* * * * *